US005956787A

United States Patent [19]

James et al.

[11] Patent Number: 5,956,787

[45] Date of Patent: Sep. 28, 1999

[54] ANTI-DECUBITUS PNEUMATIC MATTRESS

[76] Inventors: Ingrid B. James; Brian O. James, both of 324 Persimmon Rd., Walnut Creek, Calif. 94598

[21] Appl. No.: 08/960,477

[22] Filed: Oct. 31, 1997

[51] Int. Cl.[6] ..... A61G 7/057

[52] U.S. Cl. ..... 5/713; 5/715; 5/739; 5/732

[58] Field of Search ..... 5/710, 713, 715, 5/732, 739, 903, 738

[56] References Cited

U.S. PATENT DOCUMENTS

| | | | |
|---|---|---|---|
| 5,092,007 | 3/1992 | Hasty | 5/715 |
| 5,267,364 | 12/1993 | Volk | 5/710 |
| 5,394,577 | 3/1995 | James et al. | 5/715 |
| 5,619,764 | 4/1997 | Lopau | 5/715 X |
| 5,745,942 | 5/1998 | Wilkerson | 5/715 |
| 5,774,917 | 7/1998 | Liu | 5/715 |
| 5,781,949 | 7/1998 | Weismiller et al. | 5/715 |

*Primary Examiner*—Michael F. Trettel
*Attorney, Agent, or Firm*—Bauer & Schaffer, LLP

[57] ABSTRACT

An anti-decubitus pneumatic mattress adapted to replaceably overlay a conventional mattress of a bed and have a patient move in preselected ways so as to prevent the patient from having skin breakdowns, and from falling off the bed when the patient is turning, and from bottoming out on a low side of the turning, while being suspended in a cushion of static air, if power to the anti-decubitus pneumatic mattress fails. The mattress includes a main assembly, a pair of bolsters, and a bottom assembly. The main assembly is adapted to overlay the conventional mattress of the bed, and has opposing longitudinal sides, and comprises a plurality of cells that are selectively inflatable for moving the patient in the preselected ways so as to prevent the patient from having the skin breakdowns. The pair of bolsters are replaceably attached to, and extend along, the opposing longitudinal sides of the main assembly, and are inflatable, and when inflated, form barriers that prevent the patient from falling off the bed when the patient is turning. The bottom assembly is adapted to overlay the conventional mattress of the bed and underlie the main assembly, and when inflated, forms a static air space between the main assembly and the conventional mattress of the bed that prevents the patient from bottoming out on the low side of the turning, while suspending the patient in the cushion of static air if the power to the main assembly fails.

21 Claims, 5 Drawing Sheets

ANTI-DECUBITUS PNEUMATIC MATTRESS

BACKGROUND OF THE INVENTION

The present invention relates to an anti-decubitus pneumatic mattress. More particularly, the present invention relates to an anti-decubitus pneumatic mattress that is adapted to replaceably overlay a conventional mattress of a bed and have a patient lie thereon and be moved in preselected ways so as to prevent the patient from having skin breakdowns, and which prevents the patient from falling off the bed when the patient is turning, and which further prevents the patient from bottoming out on a low side of the turning, while being suspended in a cushion of static air if power fails.

DESCRIPTION OF THE PRIOR ART

A disadvantage of a conventional mattress is that after relatively short periods of time the patient becomes subject to bed sores and tissue degradation. This is particularly a problem when the patient cannot, or may not, exercise, even for a short time. Local message is a palliative measure and not very economical nor effective for long term patients.

Some patients require mattresses which extend the entire length of their bodies, while in other cases the turning movement of the patient is restricted to certain regions, for example the seat. Its is sometimes also necessary to exempt a certain region of the patient's body from the lifting pressure exerted by the mattress's air chambers.

An attempt to overcome these problems has been to provide a pneumatic air mattress. A later attempt has been to provide an air mattress by which the patient may be caused to turn periodically and thereby relieve stress on the body. A problem, however, with these known devices is that the frequency of inflation and deflation of the chambers, together with the lack of patient body movement, is often not sufficient to prevent skin breakdown.

In our U.S. Pat. No. 5,394,577, we attempt to overcome these problems by teaching a therapeutic anti-decubitus lateral rotation mattress, which is incorporated herein by reference. As shown in FIG. 1, the mattress 10 includes a plurality of pairs of inflatable air cells 12 disposed on opposite sides of a longitudinal axis 14 and arranged along the length of a bed. Each cell of the plurality of pairs of inflatable air cells 12 extends substantially transverse to the longitudinal axis 14 and are supplied with air so that cells of the plurality of pairs of inflatable air cells 12 on alternate sides are inflated, while cells of the plurality of pairs of inflatable air cells 12 on the other side are simultaneously deflated. An upper layer 16 of a resinous foam pad is provided on which the patient lies. The upper layer 16 is provided with a groove 18 along its longitudinal axis for comfort of the patient. The mattress 10 is completed by a covering 20 that has an upper sheet member 22 that is removably attached to a lower sheet member 24 so that when soiled it may be easily removed.

Although our patent appears to overcome these problems of the prior discussed supra, it only allows the patient to be turned in alternative directions, without allowing different portions of the patient to be alternatively raised and lowered. It does not prevent the patient from falling off the bed when the patient is turning, or does it prevent the patient from bottoming out on the low side of the turning, or be suspended in a cushion of static air, if power fails.

SUMMARY OF THE INVENTION

ACCORDINGLY, AN OBJECT of the present invention is to provide an anti-decubitus pneumatic mattress that avoids the disadvantages of the prior art.

ANOTHER OBJECT of the present invention is to provide an anti-decubitus pneumatic mattress that is simple and inexpensive to manufacture.

STILL ANOTHER OBJECT of the present invention is to provide an anti-decubitus pneumatic mattress that is simple to use.

BRIEFLY STATED, YET ANOTHER OBJECT of the present invention is to provide an anti-decubitus pneumatic mattress that is adapted to replaceably overlay a conventional mattress of a bed and have a patient lie thereon and be moved in preselected ways so as to prevent the patient from having skin breakdowns, and which prevents the patient from falling off the bed when the patient is turning, and which further prevents the patient from bottoming out on a low side of the turning, while being suspended in a cushion of static air, if power to the anti-decubitus pneumatic mattress fails. The mattress includes a main assembly, a pair of bolsters, and a bottom assembly. The main assembly is adapted to overlay the conventional mattress of the bed and have the patient lie thereon, and has opposing longitudinal sides, and comprises a plurality of cells that are selectively inflatable for moving the patient in the preselected ways so as to prevent the patient from having the skin breakdowns. Each bolster of the pair of bolsters is replaceably attached to, and extends along, a respective longitudinal side of the opposing longitudinal sides of the main assembly and are inflatable, and when inflated, form barriers that prevent the patient from falling off the bed when the patient is turning. The bottom assembly is adapted to overlay the conventional mattress of the bed and underlie the main assembly and is inflatable, and when inflated, forms a static air space between the main assembly and the conventional mattress of the bed that prevents the patient from bottoming out on the low side of the turning, while suspending the patient in the cushion of static air, if the power to the main assembly fails.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

DETAILED DESCRIPTION OF THE PREFERRED EMBODIMENT

Figure 1:
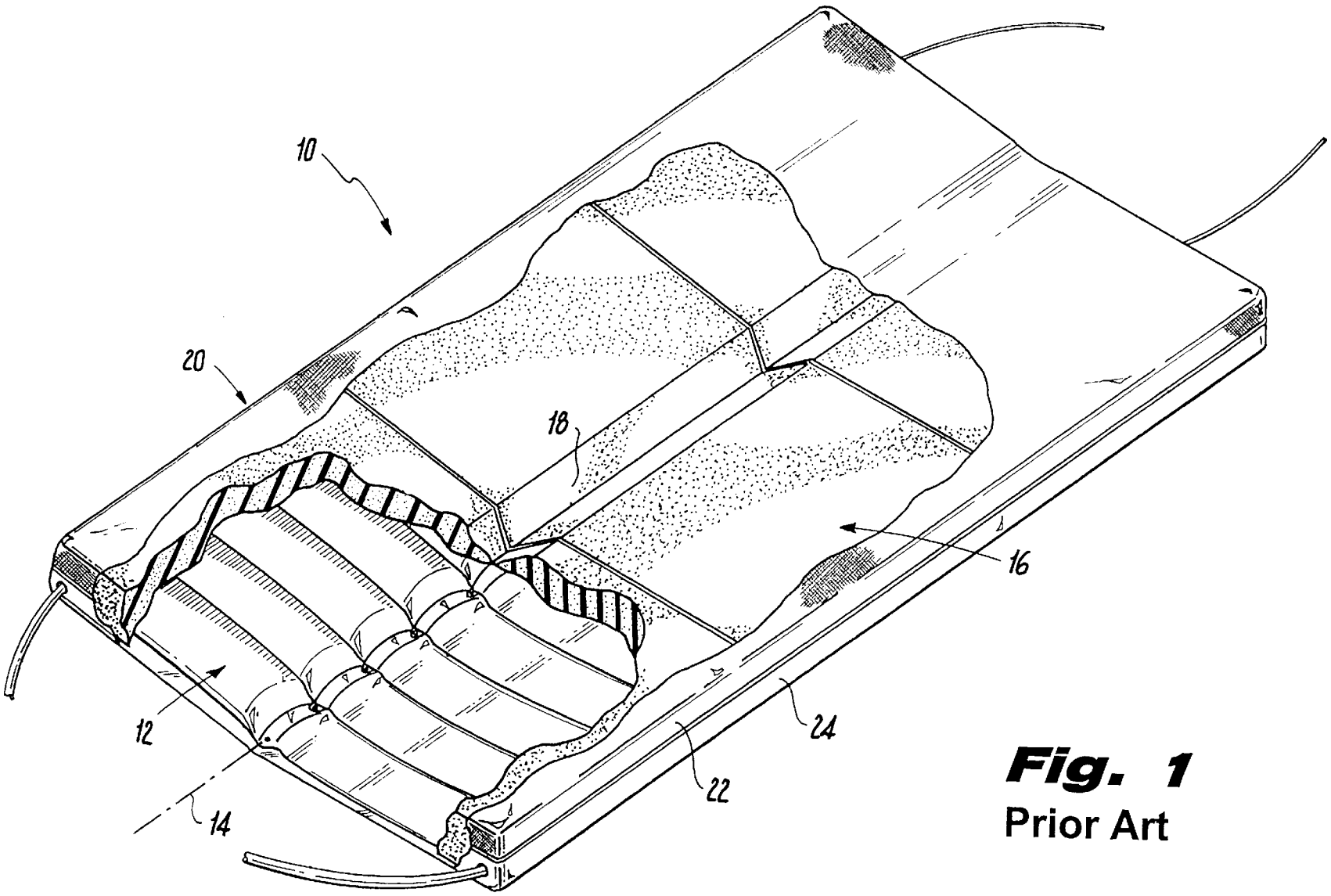
Fig. 1 Prior Art
FIG. 1 is a diagrammatic perspective view of a prior art therapeutic anti-decubitus lateral rotation mattress taught by our U.S. Pat. No. 5,394,577 to James et al.
Figure 2:
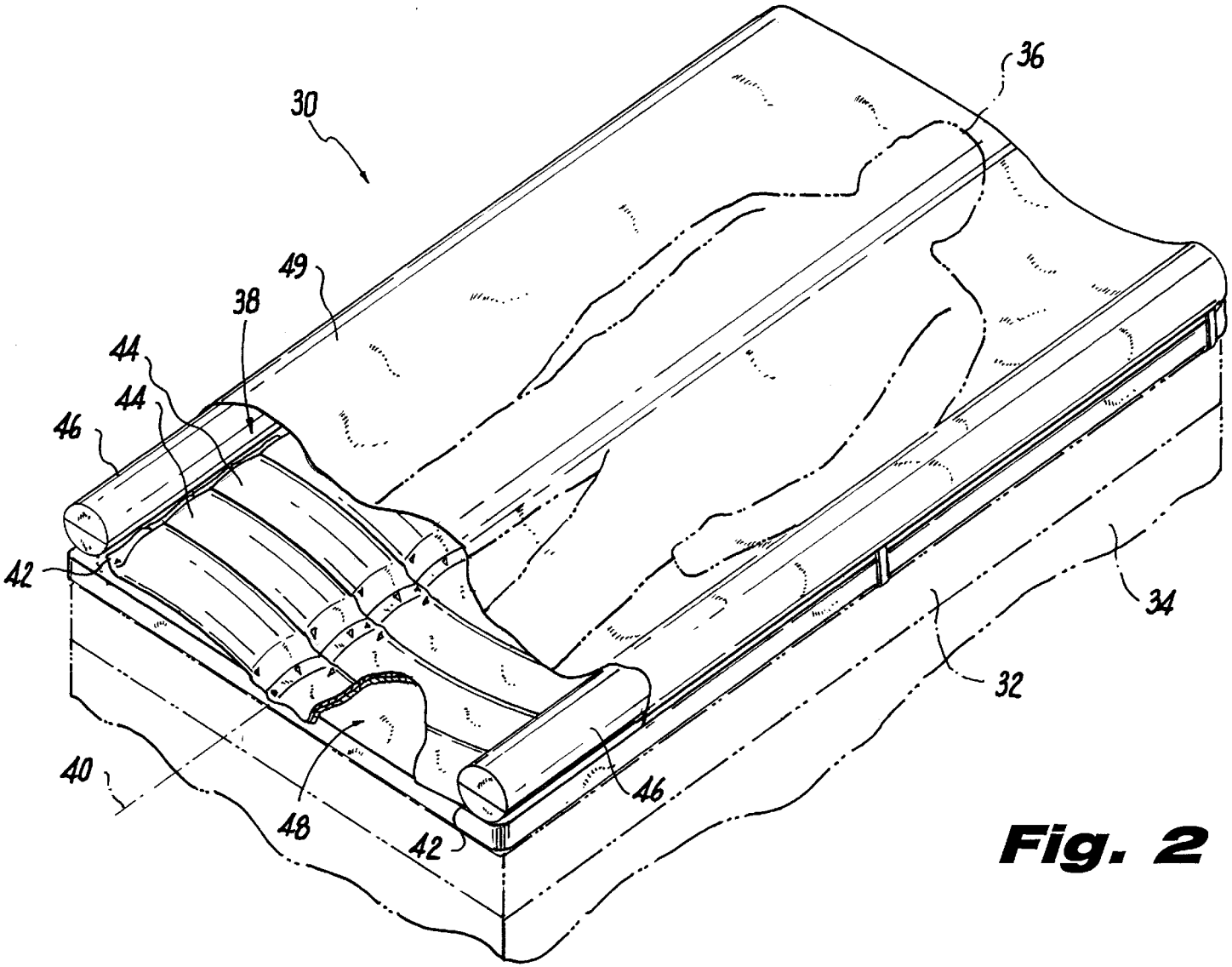
FIG. 2 is a diagrammatic perspective view of the present invention.

Referring now to the figures in which like numerals indicate like parts, and particularly to FIG. 2, the anti-decubitus pneumatic mattress of the present invention is shown generally at 30 adapted to replaceably overlay a conventional mattress 32 of a bed 34 and have a patient 36 lie thereon and be moved in preselected ways so as to prevent the patient 36 from having skin breakdowns, and which prevents the patient 36 from falling off the bed 34 when the patient 36 is turning, and which further prevents the patient 36 from bottoming out on a low side of the turning, while being suspended in a cushion of static air, if power to the anti-decubitus pneumatic mattress 30 fails.

The anti-decubitus pneumatic mattress includes a main assembly 38 that is adapted to overlay the conventional mattress 32 of the bed 34 and have the patient 36 lie thereon, and has a longitudinal axis 40 and opposing longitudinal sides 42, and comprises a plurality of cells 44 that are selectively inflatable for moving the patient 36 in the preselected ways so as to prevent the patient 36 from having the skin breakdowns.

The anti-decubitus pneumatic mattress further includes a pair of bolsters 46. Each bolster of the pair of bolsters 46 is replaceably attached to, and extends along, preferably the entire length of, a respective longitudinal side of the opposing longitudinal sides 42 of the main assembly 38, and are selectively inflatable, and when inflated, form barriers that prevent the patient 36 from falling off the bed 34 when the patient 36 is turning.

The anti-decubitus pneumatic mattress 10 further includes a bottom assembly 48 that is adapted to overlay the conventional mattress 32 of the bed 34 and underlie the main assembly 38, preferably in its entirety, and is inflatable, and when inflated, forms a static air space between the main assembly 38 and the conventional mattress 32 that prevents the patient 36 from bottoming out on the low side of the turning, while suspending the patient 36 in the cushion of static air, if the power to the main assembly fails 38.

The anti-decubitus pneumatic mattress further includes a two-piece cover 49 that replaceably encloses the main assembly 38, the pair of bolsters 46, and the bottom assembly 48, as a unit.

The configuration of the main assembly 38 can best be seen in FIGS. 3 through 5, and as such will be discussed with reference thereto.

Figure 3:
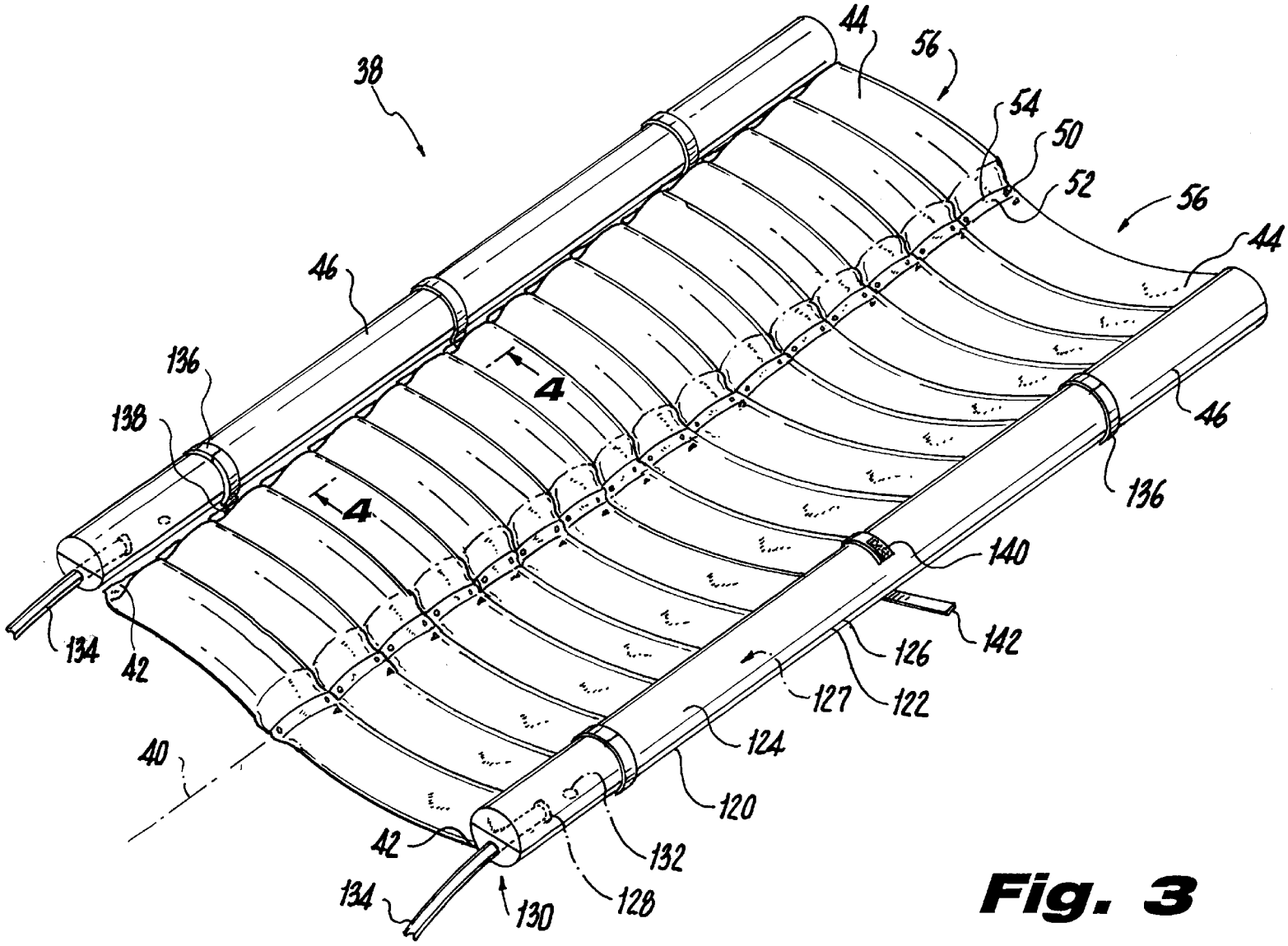
FIG. 3 is an enlarged diagrammatic perspective view of the main assembly of the present invention and the pair of bolsters of the present invention attached thereto.

As shown in FIG. 3, the plurality of cells 44 of the main assembly 38 are in edge to edge contact with each other, are substantially identical to each other, are readily interchangeable with each other, and have adjacent cells replaceably attached to each other, side by side, and end to end. The integrity of the main assembly 38 is maintained by male and female fastener elements 50 disposed on marginal flanges 52 on facing edges 54 of the plurality of cells 44.

The number of cells of the plurality of cells 44 attached side by side determine its length, with its length, in one case, allowing the main assembly 38 to support the patient 36 completely, and in another case, allowing the main assembly 38 to support only a small region of the patient 36. The length of the main assembly 38 is preferably shorter than the patient 36 so as to allow in one case, just the heels of the patient 36 to extend beyond the main assembly 38 and avoid sores thereon, while allowing in another case, only a selected portion of the patient 36 to be exempt for support.

The plurality of cells 44 are divided by the longitudinal axis 40 of the main assembly 38 into a pair of side by side banks of cells 56 that extend longitudinally, with each bank of the pair of side by side banks of cells 56 being elongated, independently formed, and separately removable.

Figure 4:
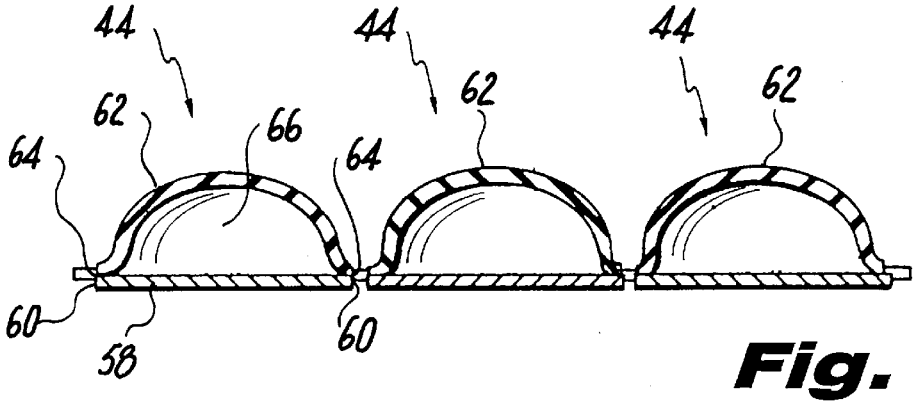
FIG. 4 is an enlarged diagrammatic cross sectional view taken on line 4—4 in FIG. 3.

A shown in FIG. 4, each cell of the plurality of cells 44 comprises a base 58 that is generally rectangular-shaped, generally planar, and non-resilient, and has peripheral edges 60. Each cell of the plurality of cells 44 further comprises a cover 62 that is resilient and has peripheral edges 64 that are fused to the peripheral edges 60 of the base 58, with the base 58 and the cover 62 defining an inflatable air chamber 66 therebetween, which when extended, by inflation, assumes a generally semi-cylindrically shape, but when contracted, by deflation, lies flat for easy storage and transport.

Each cell of the plurality of cells 44 is preferably about 6" to about 8" wide, preferably about 12" long, and inflatable to a height of preferably at least 3.5", with about 12 to about 15 cells of the plurality of cells 44 in each bank of the pair of side by side banks of cells 56 accommodating the full length of the bed 34 when the bed 34 is a hospital bed, and with about 18 cells of the plurality of cells 44 in each bank of the pair of side by side banks of cells 56 accommodating the full length of the bed 34 when the bed 34 is a home care bed of about 35" in width and about 80" in length.

Figure 5:
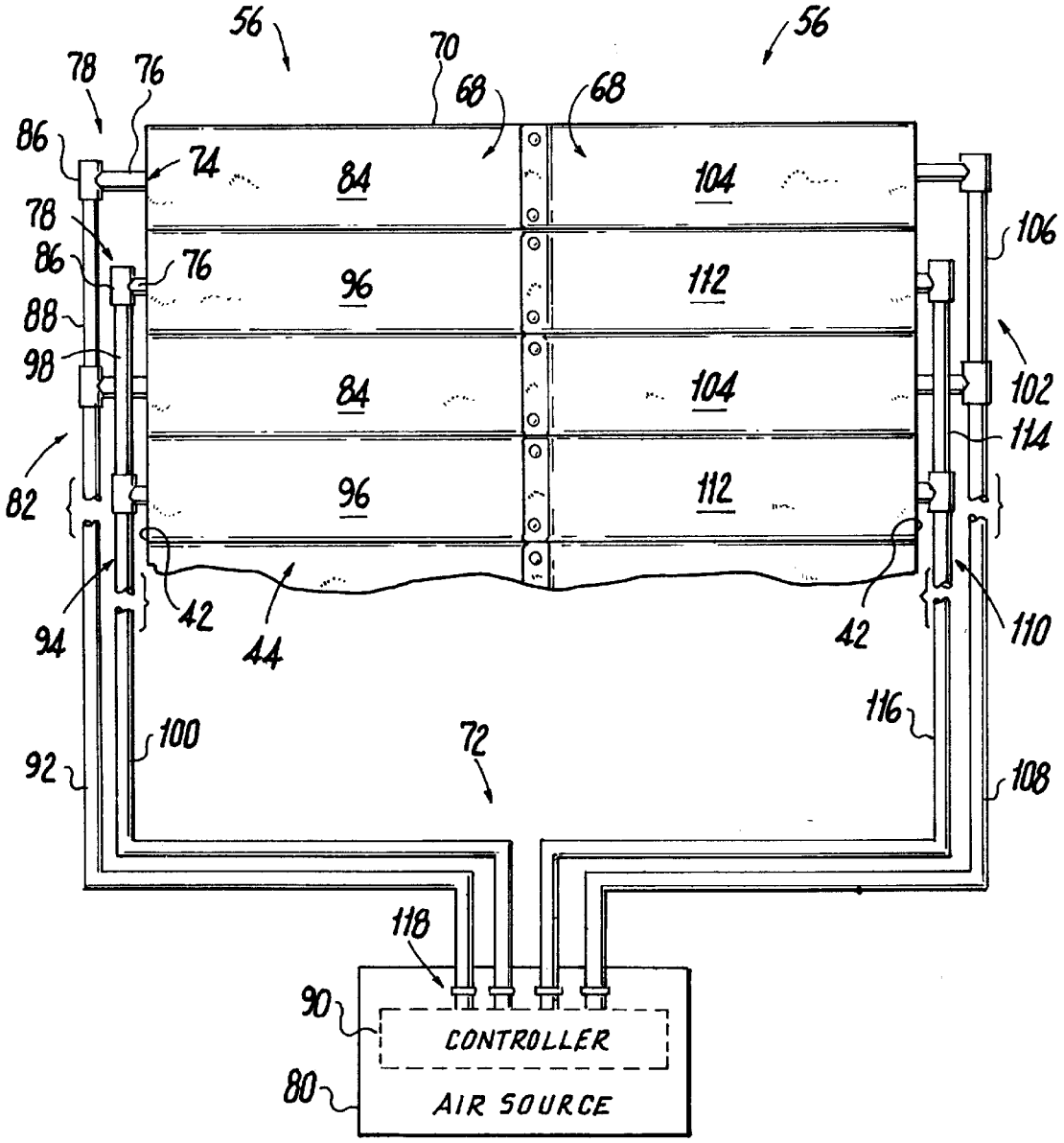
FIG. 5 is a fragmented diagrammatic perspective view illustrating the conduit distribution of the main assembly.

As shown in FIG. 5, the pair of side by side banks of cells 56 are divided into side by side rows of cells 68, whose long sides 70 extend substantially transverse to the longitudinal axis 40 of the main assembly 38.

The main assembly 38 further has four distinct air conduits 72 that are in fluid communication with the plurality of cells 44 by inlet/outlet ports 74 that have stems 76 of T-fittings 78 secured therein. The four distinct air conduits 72 fluidly connect the plurality of cells 44 to an air source 80 for selective inflation and deflation of particular cells of the plurality of cells 44, with each port of the inlet/outlet ports 74 being in fluid communication with a respective cell of the plurality of cells 44 and being disposed adjacent the opposing longitudinal sides 42 of the main assembly 38.

A first air conduit 82 of the four distinct air conduits 72 is in fluid communication with alternating cells 84 of one bank of the pair of side by side banks of cells 56, with arms 86 of the T-fittings 78 of the first air conduit 82 being in serial fluid communication with each other by first short flexible conduits 88, and with a lead T-fitting of the T-fittings 78 of the first air conduit 82 being in fluid communication with a controller 90 and the air source 80 by a first long flexible conduit 92.

A second air conduit 94 of the four distinct air conduits 72 is in fluid communication with the remaining cells 96 of the one bank of the pair of side by side banks of cells 56, with the arms 86 of the T-fittings 78 of the second air conduit 94 being in serial fluid communication with each other by second short flexible conduits 98, and with a lead T-fitting of the T-fittings 78 of the second air conduit 94 being in fluid communication with the controller 90 and the air source 80 by a second long flexible conduit 100.

A third air conduit 102 of the four distinct air conduits 72 is in fluid communication with alternating cells 104 of the other bank of the pair of side by side banks of cells 56, which are adjacent to the alternating cells 84 of the one bank of the pair of side by side banks of cells 56, with the arms 86 of the T-fittings 78 of the third air conduit 102 being in serial fluid communication with each other by third short flexible conduits 106, and with a lead T-fitting of the T-fittings 78 of the third air conduit 102 being in fluid communication with the controller 90 and the air source 80 by a third long flexible conduit 108.

A fourth air conduit 110 of the four distinct air conduits 72 is in fluid communication with the remaining cells 112 of the other bank of the pair of side by side banks of cells 56, which are adjacent to the remaining cells 96 of the one bank of the pair of side by side banks of cells 56, with the arms 86 of the T-fittings 78 of the fourth air conduit 110 being in serial fluid communication with each other by fourth short flexible conduits 114, and with a lead T-fitting of the T-fittings 78 of the fourth air conduit 110 being in fluid communication with the controller 90 and the air source 80 by a fourth long flexible conduit 116.

The air source 80 passes air at high volume, but under low pressure, through the four distinct air conduits 72, with the controller 90 having four bi-directional valves 118 that selectively allow air to pass through, and be removed from, particular conduits of the four distinct air conduits 72.

The air source 80 is preferably integral with the controller 90, and preferably is a pump that is small, since it needs to only provide high volume rather than high pressure, and with the controller 90 preferably being either mechanical or computer controlled.

The configuration of the pair of bolsters 46 can best be seen in FIG. 3, and as such will be discussed with reference thereto.

Each bolster of the pair of bolsters 46 is hollow, elongated, about 4" in diameter, and about 12.5" in circumference so as to provide a sufficient barrier to prevent the patient 36 from falling off the bed 34 when the patient 36 is turning.

Each bolster of the pair of bolsters 46 comprises a lower sheet 120 that is resilient and has peripheral edges 122, and an upper sheet 124 that is resilient and has peripheral edges 126 that are fused to the peripheral edges 122 of the lower sheet 120, with the lower sheet 120 and the upper sheet 124 defining an inflatable air chamber 127 therebetween, which when extended, by inflation, assumes a generally cylindrically shape, but when contracted, by deflation, lies flat for easy storage and transport.

The lower sheet 120 of each bolster of the pair of bolster 46 has a one-way valve 128, at a foot end 130 thereof, and a manual release valve 132 disposed slightly forward of the one-way valve 128, with the one-way valve 128 being in fluid communication with the controller 90 and the air source 80 by a fifth long flexible conduit 134.

The pair of bolsters 46 are replaceably attached to the main assembly 38 by two-piece vinyl straps 136 that are replaceably attached to the main assembly 38 by buttons 138, and which releasably encircle the pair of bolsters 46, and which are maintained therearound by hook and loop fasteners 140 disposed on their free ends 142.

Each strap of the two-piece vinyl straps 136 is about 1" in width and about 15" in length, with the length of each strap of the two-piece vinyl straps 136 being sufficient to encircle a respective bolster of the pair of bolsters 46 with sufficient overlap to engage the hook and loop fasteners 140.

The two-piece vinyl straps 136 are preferably six two-piece vinyl straps, three of which replaceably attaches one bolster of the pair of bolsters 46 to the respective longitudinal side of the opposing longitudinal sides 42 of the main assembly 38, and which are evenly spaced therealong.

Figure 6:
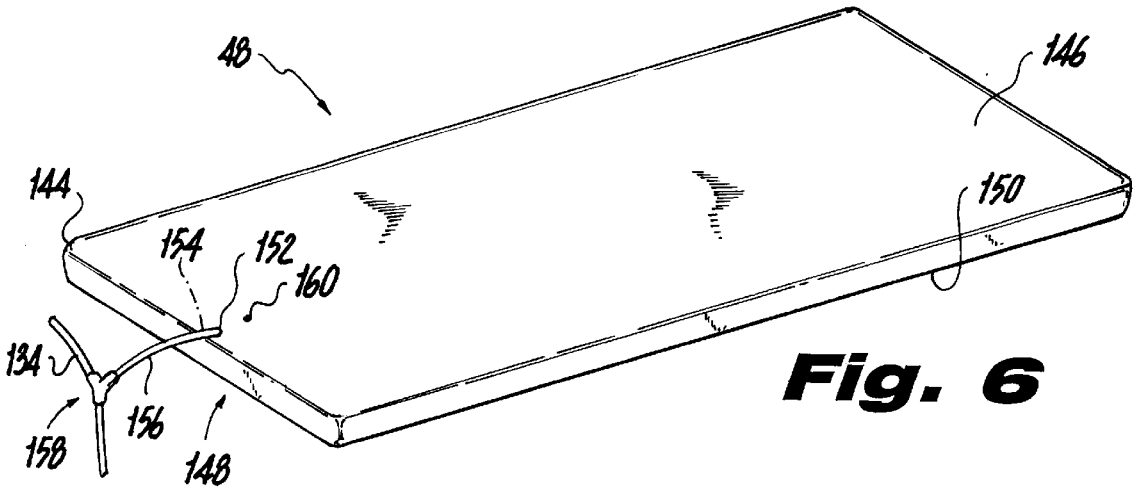
FIG. 6 is a diagrammatic perspective view of the bottom assembly of the present invention.

The configuration of the bottom assembly 48, can best be seen in FIG. 6, and as such will be discussed with reference thereto.

The bottom assembly 48 is thin, hollow, and generally rectangular-parallelepiped-shaped with rounded corners 144, and has a top 146 that underlies, preferably the entirety of, the main assembly 38 and the pair of bolsters 46, as a unit, and has a foot end 148, and a bottom 150 that is adapted to overlay the conventional mattress 32.

The bottom assembly 48 is made from vinyl, and is preferably about 2" in height, preferably about 80" in length, and preferably about 35" in width so as to accommodate the bed 34 when the bed 34 is a home care bed of about 35" in width and about 80" in length.

The top 146 of the bottom assembly 48 has an inlet port 152 with a one-way valve 154 that is in fluid communication with the controller 90 and the air source 80 by a short flexible conduit 156 which is in fluid communication with the fifth long air conduit 134 by a Y-fitting 158 so as to allow the pair of bolsters 46 and the bottom assembly 48 to be inflated simultaneously, with the inlet port 152 being centered about 2" in from the foot end 148 of the top 146 of the bottom assembly 48.

The top 146 of the bottom assembly 48 further has an air escape valve 160 that permits any excess air to escape and keeps the bottom assembly 48 at a constant pressure of about 0.5 lb, and which is centered about 10" in from the foot end 148 of the bottom assembly 48.

The configuration of the two-piece cover 49 can best be seen in FIGS. 7 and 8, and as such will be discussed with reference thereto.

The two-piece cover 49 is hollow and generally rectangular-parallelepiped-shaped, and conforms substantially to the main assembly 38, the pair of bolsters 46, and the bottom assembly 48, as a unit.

Figure 7:
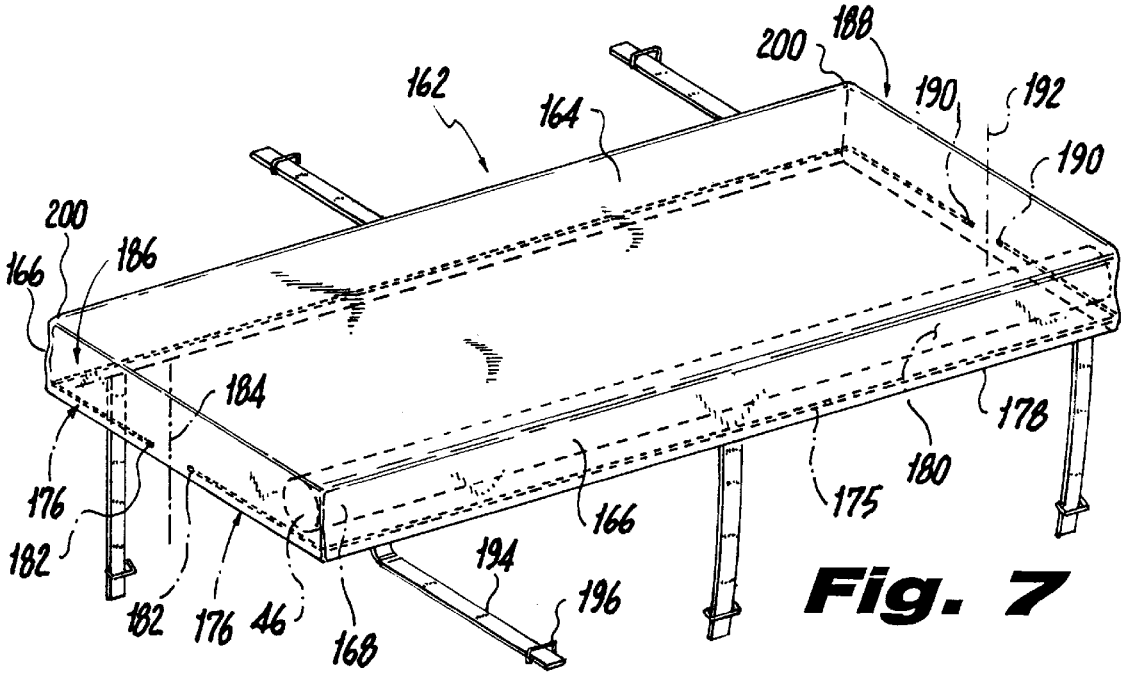
FIG. 7 is a diagrammatic perspective view of the top sheet of the two-piece cover of the present invention.

As shown in FIG. 7, the two-piece cover 49 includes a top sheet 162 with a planar base 164 that overlays the main portion 38, and depending peripheral walls 166 that are slightly downwardly outwardly flaring, and which overlay side portions 168 of the pair of bolsters 46.

The top sheet 162 is about 35" in width, about 80" in length, and about 5.5" in height so as to accommodate the main assembly 38 and the pair of bolsters 46, as a unit, and is made from a two-way stretch fabric, lined with quilting that is comfortable for the patient 36 lying thereon. The two-way stretch fabric is either moleskin, flannel, or the like, with a typical such fabric being one sold under the trade name DARTEX™, which conforms to California code 117 Section E (CS 191-53), and which has a polyurethane coating thereon that is bacteriostatic, fluid-proof, non-staining, and moisture vapor permeable.

The depending sides 166 of the top sheet 162 have a run of teeth 175 of two zippers 176 disposed slightly before their termination edges 178, on inner surfaces thereof 180. The run of teeth 175 of the two zippers 176 have their origination stops 182 at a center 184 of a foot end wall 186 of the depending peripheral walls 166, and extend laterally outwardly therefrom, in opposite directions, along the foot end wall 186 of the top sheet 162, longitudinally along a respective longitudinal wall of the depending peripheral walls 166, laterally inwardly, in opposite directions, along a head end wall 188 of the depending peripheral walls 166, which opposes the foot end wall 186, and have their termination stops 190 at a center 192 of the head end wall 188, with each zipper of the two zippers 176 being about 115" in length.

The top sheet 162 further has six non-slip nylon straps 194 with D-rings 196 for replaceably securing the main assembly 38, the pair of bolsters 46, and the bottom assembly 48, as a unit, to a frame of the bed 34 so as to prevent the main assembly 38, the pair of bolsters 46, and the bottom assembly 48 from falling off the bed 34 when the patient 36 is lying thereon.

The six non-slip nylon straps 194 depend from all four corners 200 of the top sheet 162, and midway between each widest separated pair of straps of the six non-slip nylon straps 194, with each strap of the six non-slip nylon straps 194 being about 1" wide and about 25" long so as to provide sufficient securement to the frame of the bed 34.

Figure 8:
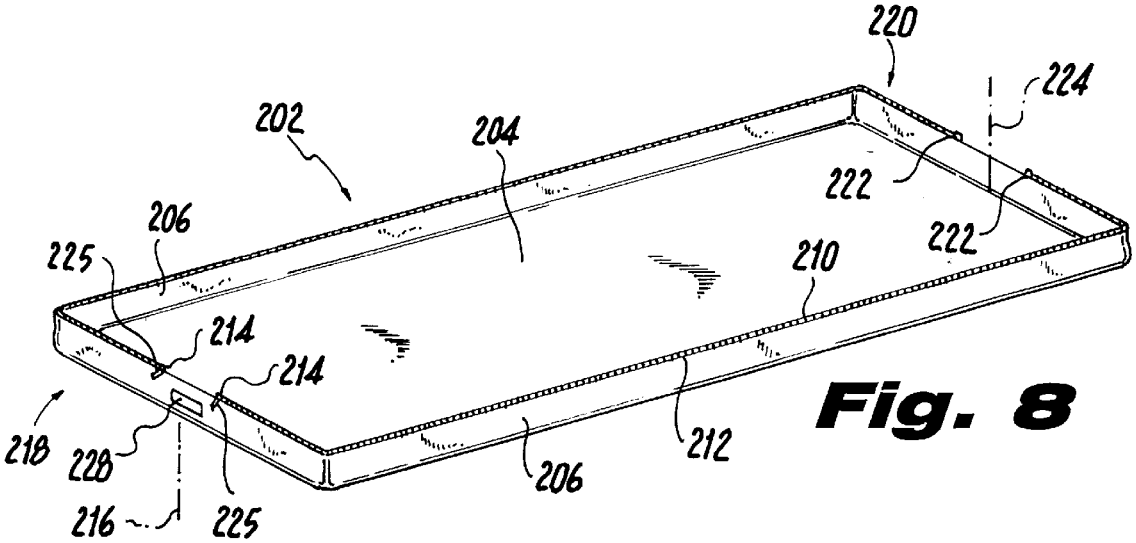
FIG. 8 is a diagrammatic perspective view of the bottom sheet of the two-piece cover of the present invention.

As shown in FIG. 8, the two-piece cover 49 further includes a bottom sheet 202 with a planar base 204 that underlies the bottom assembly 48, and upstanding peripheral walls 206 that overlay side portions of the bottom assembly 48, with the bottom sheet 202 being about 35" in width, about 80" in length, and about 2 in height so as to accommodate the bottom assembly 48. The bottom sheet 202 is made from a fabric that is strong, resistant to fluids, bacteria, fire, stains and tears, and self-deodorizing, non-allergenic, and anti-static, with a typical such fabric being one sold under the trade name STAPH-CHEK COMFORT®.

The upstanding peripheral walls 206 of the bottom sheet 202 have a mating run of teeth 210 of the two zippers 176 disposed at their termination edges 212. The mating run of teeth 210 of the two zippers 176 have their origination stops 214 at a center 216 of a foot end wall 218 of the upstanding peripheral walls 206, and extend laterally outwardly therefrom, in opposite directions, along the foot end wall 218, longitudinally along a respective longitudinal wall of the upstanding peripheral walls 206, laterally inwardly, in opposite directions, along a head end wall 220 of the upstanding peripheral walls 206, which opposes the foot end wall 218, and have their termination stops 222 at a center 224 of the head end wall 220.

The mating run of teeth 210 of the two zippers 176 selectively mate with the run of teeth 175 of the two zippers 176 by pull slides 225 disposed at their origination stops 182, 214 so as to be readily accessible for easy opening of the two-piece cover 49 when the top sheet 162 requires replacement, without having to fully dismantle the anti-decubitus pneumatic mattress 30, and which also facilitates monitoring of the main assembly 38, and with the termination edges 178 of the depending peripheral walls 166 of the top sheet 162 forming a flap 226 for concealing and forming invisible zippers.

The bottom sheet 202 further has a rectangular stitched throughbore 228 that is centered in the foot end wall 218 thereof, and which is about 0.75" in height and about 2.5" in length so as to easily accommodate passage of at least the first long flexible conduit 92, the second long flexible conduit 100, the third long flexible conduit 108, the fourth long flexible conduit 116, and the fifth long flexible conduit 134 outwardly therethrough.

In operation, to turn the patient 36 in alternative directions, one bank of the pair of side by side banks of cells 56 is inflated, while the other bank of the pair of side by side banks of cells 56 is simultaneously deflated, and vise versa. To accomplish this, the controller 90 passes air from the air source 80 through the first conduit 82 and the second conduit 94 and inflates the one bank of the pair of side by side banks of cells 56, while simultaneously removes air through the third conduit 102 and the fourth conduit 110 and deflates the other bank of the pair of side by side banks of cells 56, and vise versa.

To raise and lower different parts of the patient 36, alternating rows of the side by side rows of cells 68 of the pair of side by side banks of cells 56 are inflated, while the remaining rows of the side by side rows of cells 68 of the pair of side by side banks of cells 56 are simultaneously deflated, and vise versa. To accomplish this, the controller 90 passes air from the air source 80 through the first conduit 82 and the third conduit 102 and inflates the alternating rows 68 of the pair of side by side banks of cells 56, while simultaneously removes air through the second conduit 94 and the fourth conduit 110 and deflates the remaining rows of the side by side rows of cells 68 of the pair of side by side banks of cells 56, and vise versa.

It will be understood that each of the elements described above, or two or more together, may also find a useful application in other types of constructions differing from the types described above.

While the invention has been illustrated and described as embodied in an anti-decubitus pneumatic mattress, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An anti-decubitus pneumatic mattress adapted to replaceably overlay a conventional mattress of a bed and have a patient lie thereon, said anti-decubitus pneumatic mattress comprising:

a) a main assembly adapted to overlay the conventional mattress of the bed and have the patient lie thereon, and having a longitudinal axis and opposing longitudinal sides, and comprising a plurality of cells being selectively inflatable for turning the patient so as to prevent the patient from having skin breakdowns;

b) a pair of bolsters, each of which being replaceably attached to, and extending along, a respective longitudinal side of said opposing longitudinal sides of said main assembly, and being selectively inflatable, and when inflated, forming barriers preventing the patient from falling off the bed when the patient is turning by way of said plurality of cells of said main assembly;

c) a bottom assembly adapted to overlay the conventional mattress of the bed and underlie said main assembly, and being inflatable, and when inflated, forming a static air space between said main assembly and the conventional mattress of the bed preventing the patient from bottoming out on a low side of turning, while suspending the patient in the cushion of static air, if power to said main assembly fails; and d) first means for selectively inflating said plurality of cells of said main assembly, each of said pair of bolsters, and said bottom assembly.

2. The anti-decubitus pneumatic mattress as defined in claim 1, wherein said plurality of cells are in edge to edge contact with each other, are substantially identical to each other, and are readily interchangeable with each other.

3. The anti-decubitus pneumatic mattress as defined in claim 1, wherein each cell of said plurality of cells comprises a base that is generally rectangular-shaped, generally planar, and non-resilient, and has peripheral edges; each cell of said plurality of cells further comprises a cover that is resilient and has peripheral edges that are fused to said peripheral edges of said base, with said base and said cover defining an inflatable air chamber therebetween, which when extended, by inflation, assumes a generally semi-cylindrically shape, but when contracted, by deflation, lies flat for easy storage and transport.

4. The anti-decubitus pneumatic mattress as defined in claim 1, wherein the number of cells of said plurality of cells attached side by side determine its length, with its length in one case, allowing said main assembly to support the patient completely, and in another case, allowing said main assembly to support only a small region of the patient.

5. The anti-decubitus pneumatic mattress as defined in claim 1, wherein said plurality of cells are divided by said longitudinal axis of said main assembly into a pair of side by side banks of cells that extend longitudinally and wherein each bank of said pair of side by side banks of cells is elongated, independently formed, and separately removable.

6. The anti-decubitus pneumatic mattress as defined in claim 5, including means wherein one bank of said pair of side by side banks of cells is inflated, while the other bank of said pair of side by side banks of cells is simultaneously deflated, and vise versa so as to cause the patient to turn in alternative directions.

7. The anti-decubitus pneumatic mattress as defined in claim 6, wherein said first means includes:

a) a first air conduit in fluid communication with alternating cells of one bank of said pair of side by side banks of cells, with arms of T-fittings of said first air conduit being in serial fluid communication with each other by first short flexible conduits, and with a lead T-fitting of said T-fittings of said first air conduit being in fluid communication with a controller and an air source by a first long flexible conduit;

b) a second air conduit in fluid communication with remaining cells of said one bank of said pair of side by side banks of cells, with arms of T-fittings of said second air conduit being in fluid communication with each other by second short flexible conduits, and with a lead T-fitting of said T-fittings of said second air conduit being in fluid communication with said controller and said air source by a second long flexible conduit;

c) a third air conduit in fluid communication with alternating cells of the other bank of said pair of side by side banks of cells, which are adjacent said alternating cells of said one bank of said pair of side by side banks of cells, with arms of T-fittings of said third air conduit being in serial fluid communication with each other by third short flexible conduits, and with a lead T-fitting of said T-fittings of said third air conduit being in fluid communication with said controller and said air source by a third long flexible conduit;

d) a fourth air conduit in fluid communication with remaining cells of said other bank of said pair of side by side banks of cells, which are adjacent said remaining cells of said one bank of said pair of side by side banks of cells, with arms of T-fittings of said fourth air conduit being in serial fluid communication with each other by fourth short flexible conduits, and with a lead T-fitting of said T-fittings of said fourth air conduit being in fluid communication with said controller and said air source by a fourth long flexible conduit; and e) second means for controlling the selective inflation of said cells causing the patient to turn in alternative directions by passing air through said first conduit and said second conduit, and inflating said one bank of said pair of side by side banks of cells, while simultaneously removing air through said third conduit and said fourth conduit, and deflating said other bank of said pair of side by side banks of cells, and vise versa; said second means further causing different parts of the patient to alternatively rise and lower by passing air through said first conduit and said third conduit, and inflating alternating rows of said pair of side by side banks of cells, while simultaneously removing air through said second conduit and said fourth conduit, and deflating remaining rows of said pair of side by side banks of cells.

8. The anti-decubitus pneumatic mattress as defined in claim 7, wherein said air source passes air at high volume, but under low pressure, through said four distinct air conduits, and said controller has four bi-directional valves that selectively allow air to pass through, and be removed from, particular conduits of said four distinct air conduits.

9. The anti-decubitus pneumatic mattress as defined in claim 1, wherein each bolster of said pair of bolsters is hollow and elongated, and extends along the entirety of a respective side of said opposing longitudinal sides of said main assembly.

10. The anti-decubitus pneumatic mattress as defined in claim 9, wherein each bolster of said pair of bolster comprises a lower sheet that is resilient and has peripheral edges, and an upper sheet that is resilient and has peripheral edges that are fused to said peripheral edges of said lower sheet, with said lower sheet and said upper sheet defining an inflatable air chamber therebetween that when extended, by inflation, assumes a generally cylindrically shape, but when contracted, by deflation, lies flat for easy storage and transport.

11. The anti-decubitus pneumatic mattress as defined in claim 10, wherein said lower sheet of each bolster of said pair of bolster has a one-way valve at a foot end thereof, and a manual release valve slightly forward of said one-way valve, said one-way valve being in fluid communication with a controller and an air source by a fifth long flexible conduit for selectively feeding air to said bolsters.

12. The anti-decubitus pneumatic mattress as defined in claim 1, wherein said pair of bolsters are replaceably attached to said opposing longitudinal sides of said main assembly by straps.

13. The anti-decubitus pneumatic mattress as defined in claim 12, wherein said straps include two-piece vinyl straps that have free ends and are replaceably attached to said main assembly by buttons, and which releasably encircle said pair of bolsters, and which are maintained therearound by hook and loop fasteners on their free ends.

14. The anti-decubitus pneumatic mattress as defined in claim 13, wherein each strap of said two-piece vinyl straps is about 1" in width and about 15" in length, with said length of each strap of said two-piece vinyl straps being sufficient to encircle a respective bolster of said pair of bolsters with sufficient overlap to engage said hook and loop fasteners on said free ends thereof.

15. The anti-decubitus pneumatic mattress as defined in claim 1, wherein said bottom assembly is thin, hollow, and generally rectangular-parallelepiped-shaped with rounded corners, and has a top that underlies the entirety of said main assembly and said pair of bolsters, as a unit, and has a foot end; said bottom assembly further has a bottom that is adapted to overlay the conventional mattress of the bed.

16. The anti-decubitus pneumatic mattress as defined in claim 1, wherein a top of said bottom assembly has an inlet port with a one-way valve that is in fluid communication with a controller and an air source by a short flexible conduit that is in fluid communication with a fifth long air conduit by a Y-fitting, which allows said pair of bolsters and said bottom assembly to be inflated simultaneously.

17. The anti-decubitus pneumatic mattress as defined in claim 15, wherein said top of said bottom assembly further has an air escape valve that permits any excess air to escape and keeps said bottom assembly at a constant pressure of about 0.5 lb.

18. The anti-decubitus pneumatic mattress as defined in claim 1; further comprising a two-piece cover for replaceably enclosing said main assembly, said pair of bolsters, and said bottom assembly, as a unit.

19. The anti-decubitus pneumatic mattress as defined in claim 18, wherein said two-piece cover is hollow and generally rectangular-parallelepiped-shaped, and conforms substantially to said main assembly, said pair of bolsters, and said bottom assembly, as a unit, said two-piece cover including a top sheet with a planar base that overlays said main portion, and depending peripheral walls that are slightly downwardly outwardly flaring, and which overlay side portions of said pair of bolsters.

20. The anti-decubitus pneumatic mattress as defined in claim 19, wherein said top sheet of said two-piece cover further has cover securing means for replaceably securing said main assembly, said pair of bolsters, and said bottom assembly, as a unit, to a frame of the bed, while preventing said main assembly, said pair of bolsters, and said bottom assembly from falling off the bed when the patient is lying thereon.

21. An anti-decubitus pneumatic mattress adapted to replaceably overlay a conventional mattress of a bed and have a patient lie thereon, said anti-decubitus pneumatic mattress comprising:

a) a main assembly adapted to overlay the conventional mattress of the bed and have the patient lie thereon, and having a longitudinal axis and opposing longitudinal sides, and comprising a plurality of cells being selectively inflatable for turning the patient so as to prevent the patient from having skin breakdowns; said plurality of cells being divided by said longitudinal axis of said main assembly into a pair of side by side banks of cells extending longitudinally and wherein each bank of said pair of side by side banks of cells being elongated, independently formed, and separately removable; one bank of said pair of side by side banks of cells being inflated, while the other bank of said pair of side by side banks of cells being simultaneously deflated, and vise versa, so as to cause the patient to turn in alternative directions;

b) a pair of bolsters, each of which being replaceably attached to, and extending along, a respective longitudinal side of said opposing longitudinal sides of said main assembly, and being selectively inflatable, and when inflated, forming barriers preventing the patient from falling off the bed when the patient is turning by way of said plurality of cells of said main assembly;

c) a bottom assembly adapted to overlay the conventional mattress of the bed and underlie said main assembly, and being inflatable, and when inflated, forming a static air space between said main assembly and the conventional mattress of the bed preventing the patient from bottoming out on a low side of turning, while suspending the patient in the cushion of static air, if power to said main assembly fails; and d) first means for selectively inflating said plurality of cells of said main assembly, each of said pair of bolsters, and said bottom assembly; said first means including:

i) a first air conduit fluidly communicating with alternating cells of said one bank of said pair of side by side banks of cells, with arms of T-fittings of said first air conduit serially fluidly communicating with each other by first short flexible conduits, and with a lead T-fitting of said T-fittings of said first air conduit fluidly communicating with a controller and an air source by a first long flexible conduit;

ii) a second air conduit fluidly communicating with remaining cells of said one bank of said pair of side by side banks of cells, with arms of T-fittings of said second air conduit fluidly communicating with each other by second short flexible conduits, and with a lead T-fitting of said T-fittings of said second air conduit fluidly communicating with said controller and said air source by a second long flexible conduit;

iii) a third air conduit fluidly communicating with alternating cells of said other bank of said pair of side by side banks of cells, which are adjacent said alternating cells of said one bank of said pair of side by side banks of cells, with arms of T-fittings of said third air conduit being serially fluidly communicating with each other by third short flexible conduits, and with a lead T-fitting of said T-fittings of said third air conduit fluidly communicating with said controller and said air source by a third long flexible conduit;

iv) a fourth air conduit fluidly communicating with remaining cells of said other bank of said pair of side by side banks of cells, which are adjacent said remaining cells of said one bank of said pair of side by side banks of cells, with arms of T-fittings of said fourth air conduit serially fluidly communicating with each other by fourth short flexible conduits, and with a lead T-fitting of said T-fittings of said fourth air conduit fluidly communicating with said controller and said air source by a fourth long flexible conduit; and v) second means for controlling the selective inflation of said cells causing the patient to turn in alternative directions by passing air through said first conduit and said second conduit, and inflating said one bank of said pair of side by side banks of cells, while simultaneously removing air through said third conduit and said fourth conduit, and deflating said other bank of said pair of side by side banks of cells, and vise versa; said second means further causing different parts of the patient to alternatively rise and lower by passing air through said first conduit and said third conduit, and inflating alternating rows of said pair of side by side banks of cells, while simultaneously removing air through said second conduit and said fourth conduit, and deflating remaining rows of said pair of side by side banks of cells.

* * * * *